US010278557B2

(12) United States Patent
Rukavina

(10) Patent No.: US 10,278,557 B2
(45) Date of Patent: May 7, 2019

(54) VACUUM CLEANER

(71) Applicant: Techtronic Industries Co. Ltd., Tsuen Wan, New Territories (HK)

(72) Inventor: Douglas M Rukavina, Massillon, OH (US)

(73) Assignee: Techtronic Industries Co. Ltd., Tsuen Wan, New Territories (HK)

( * ) Notice: Subject to any disclaimer, the term of this patent is extended or adjusted under 35 U.S.C. 154(b) by 14 days.

(21) Appl. No.: 15/300,131

(22) PCT Filed: Apr. 3, 2015

(86) PCT No.: PCT/US2015/024199

§ 371 (c)(1),
(2) Date: Sep. 28, 2016

(87) PCT Pub. No.: WO2015/153943

PCT Pub. Date: Oct. 8, 2015

(65) Prior Publication Data

US 2017/0172366 A1 Jun. 22, 2017

Related U.S. Application Data

(60) Provisional application No. 61/975,332, filed on Apr. 4, 2014.

(51) Int. Cl.

| | |
|---|---|
| ***A47L 9/16*** | (2006.01) |
| ***A47L 5/28*** | (2006.01) |
| ***A47L 9/12*** | (2006.01) |

(52) U.S. Cl.

CPC ..... *A47L 9/1691* (2013.01); *A47L 5/28* (2013.01); *A47L 9/122* (2013.01); *A47L 9/1666* (2013.01); *A47L 9/1683* (2013.01)

(58) Field of Classification Search

CPC ..... A47L 5/28; A47L 9/1666; A47L 9/1683; A47L 9/1691; A47L 9/122

See application file for complete search history.

(56) References Cited

U.S. PATENT DOCUMENTS

| | | | |
|---|---|---|---|
| 4,373,228 | A | 2/1983 | Dyson |
| 5,477,586 | A | 12/1995 | Jacobs |
| 6,141,826 | A | 11/2000 | Conrad |

(Continued)

FOREIGN PATENT DOCUMENTS

| | | | |
|---|---|---|---|
| CN | 1524485 | C | 9/2004 |
| CN | 100358455 | C | 1/2008 |

(Continued)

OTHER PUBLICATIONS

European Search Report for Application No. 07855490 dated May 12, 2010 (2 pages).

(Continued)

*Primary Examiner* — Marc Carlson

(74) *Attorney, Agent, or Firm* — Michael Best & Friedrich LLP

(57) ABSTRACT

A vacuum cleaner that includes a suction source, a main body, a dirt separator removably coupled to the main body, a pre-motor filter in contacting engagement with the main body in a vertically orientated plane, and a post-motor filter in contacting engagement with the main body along the vertically orientated plane.

25 Claims, 7 Drawing Sheets

(56) References Cited

U.S. PATENT DOCUMENTS 6,168,641 B1 1/2001 Tuvin
6,173,474 B1 1/2001 Conrad
6,502,277 B1 1/2003 Petersson
6,782,585 B1 8/2004 Conrad
7,069,619 B2 * 7/2006 Bowden ..... A47L 5/32 15/334
RE39,473 E 1/2007 Salo
7,305,735 B2 12/2007 Overvaag
7,501,002 B2 3/2009 Han
7,651,544 B1 1/2010 Fester
7,686,861 B2 3/2010 Oh
7,736,408 B2 6/2010 Armin
7,931,716 B2 4/2011 Oakham
7,976,597 B2 7/2011 Smith
8,117,712 B2 2/2012 Dyson
8,161,599 B2 4/2012 Griffith
8,438,700 B2 5/2013 Makarov
2002/0043055 A1 4/2002 Conrad
2002/0166200 A1 11/2002 Conrad
2003/0084537 A1 5/2003 Conrad
2003/0200734 A1 10/2003 Conrad
2003/0226232 A1 12/2003 Hayashi
2004/0060146 A1 4/2004 Coates
2004/0163207 A1 8/2004 Oh
2004/0182053 A1 9/2004 Conrad
2004/0194250 A1 10/2004 Conrad
2004/0231091 A1 11/2004 Oh
2005/0132529 A1 6/2005 Davidshofer
2005/0138763 A1 * 6/2005 Tanner ..... A47L 9/165 15/353
2005/0150075 A1 7/2005 Takemoto
2005/0160554 A1 7/2005 Ueyama
2005/0166560 A1 8/2005 Takemoto
2005/0177974 A1 8/2005 Mcfarland
2005/0223519 A1 10/2005 Greene
2005/0241284 A1 11/2005 Yoshida
2005/0262658 A1 12/2005 Conrad
2006/0000195 A1 1/2006 Lim
2006/0016043 A1 1/2006 Matsuhashi
2006/0090290 A1 5/2006 Lau
2006/0117721 A1 6/2006 Lee
2006/0123590 A1 6/2006 Fester
2006/0123751 A1 6/2006 Hayashi
2006/0137310 A1 6/2006 Conrad
2006/0168923 A1 8/2006 Lee
2006/0218744 A1 10/2006 Hayashi
2006/0254226 A1 11/2006 Jeon
2006/0272299 A1 12/2006 Choi
2006/0277712 A1 12/2006 Kim
2007/0011998 A1 1/2007 Yoo
2007/0012003 A1 1/2007 Oh
2007/0186521 A1 8/2007 Yoshida
2007/0199284 A1 8/2007 Yoo
2007/0204424 A1 9/2007 Conrad
2007/0289263 A1 12/2007 Oh
2007/0289264 A1 12/2007 Oh
2007/0289444 A1 12/2007 Tsuchiya
2008/0134460 A1 6/2008 Conrad
2008/0172992 A1 7/2008 Conrad
2008/0172995 A1 7/2008 Conrad
2008/0178416 A1 7/2008 Conrad
2008/0178418 A1 7/2008 Conrad
2008/0178420 A1 7/2008 Conrad
2008/0179133 A1 7/2008 Conrad
2008/0184893 A1 8/2008 Oh
2008/0196194 A1 8/2008 Conrad
2008/0196195 A1 8/2008 Conrad
2008/0196196 A1 8/2008 Conrad
2008/0196197 A1 8/2008 Gravely
2008/0196366 A1 8/2008 Conrad
2008/0196745 A1 8/2008 Conrad
2008/0209666 A1 9/2008 Conrad
2008/0209671 A1 9/2008 Conrad
2008/0216281 A1 9/2008 Conrad
2008/0216282 A1 9/2008 Conrad
2009/0133370 A1 5/2009 Yoo
2009/0158932 A1 6/2009 Arnold
2009/0178229 A1 7/2009 Yoo
2009/0178230 A1 7/2009 Yoo
2009/0178233 A1 7/2009 Yoo
2009/0178234 A1 7/2009 Yoo
2009/0178568 A1 7/2009 Yoo
2009/0235482 A1 9/2009 Tanner
2009/0265877 A1 10/2009 Dyson
2009/0307863 A1 12/2009 Milne
2009/0307864 A1 12/2009 Dyson
2009/0313958 A1 12/2009 Gomiciaga-Pereda
2009/0313959 A1 12/2009 Gomiciaga-Pereda
2010/0154367 A1 6/2010 Luo
2010/0175217 A1 7/2010 Conrad
2010/0205916 A1 8/2010 Yoo
2010/0209271 A1 8/2010 Yoo
2010/0212104 A1 8/2010 Conrad
2010/0212106 A1 8/2010 Sepke
2010/0219579 A1 9/2010 Kato
2010/0224073 A1 9/2010 Oh
2010/0229321 A1 9/2010 Dyson
2010/0229323 A1 9/2010 Conrad
2010/0229325 A1 9/2010 Conrad
2010/0229327 A1 9/2010 Conrad
2010/0229328 A1 9/2010 Conrad
2010/0236014 A1 9/2010 Fester
2010/0242210 A1 9/2010 Conrad
2010/0242421 A1 9/2010 Conrad
2010/0243158 A1 9/2010 Conrad
2010/0251506 A1 * 10/2010 Conrad ..... A47L 5/225 15/344
2010/0251507 A1 10/2010 Conrad
2010/0263161 A1 10/2010 Lee
2010/0281648 A1 11/2010 Lee
2010/0299865 A1 12/2010 Conrad
2010/0299866 A1 12/2010 Conrad
2011/0146024 A1 6/2011 Conrad
2011/0219570 A1 9/2011 Conrad
2011/0219572 A1 9/2011 Conrad
2011/0219576 A1 9/2011 Conrad
2011/0219577 A1 9/2011 Conrad
2011/0219579 A1 9/2011 Conrad
2011/0219733 A1 9/2011 Greene
2011/0225766 A1 9/2011 Xue
2011/0289719 A1 12/2011 Han
2011/0289720 A1 12/2011 Han
2012/0117927 A1 5/2012 Oh
2012/0151712 A1 6/2012 Oh
2012/0167336 A1 7/2012 Tran
2012/0186038 A1 7/2012 Conrad
2012/0204378 A1 8/2012 Conrad
2012/0222232 A1 9/2012 Conrad
2012/0222238 A1 9/2012 Conrad
2012/0222239 A1 9/2012 Conrad
2012/0222240 A1 9/2012 Conrad
2012/0222241 A1 9/2012 Conrad
2012/0222242 A1 9/2012 Conrad
2012/0222243 A1 9/2012 Conrad
2012/0222244 A1 9/2012 Conrad
2012/0222245 A1 9/2012 Conrad
2012/0222246 A1 9/2012 Conrad
2012/0222247 A1 9/2012 Conrad
2012/0222248 A1 9/2012 Conrad
2012/0222262 A1 9/2012 Conrad
2012/0222263 A1 * 9/2012 Conrad ..... A47L 9/00 15/412
2012/0233971 A1 9/2012 Kim
2012/0266576 A1 10/2012 Gomiciaga-Pereda
2013/0014342 A1 1/2013 Greer
2013/0055691 A1 3/2013 Kim
2013/0104335 A1 5/2013 Conrad
2013/0185893 A1 7/2013 Conrad
2013/0269146 A1 10/2013 Conrad
2013/0269147 A1 10/2013 Conrad
2013/0305483 A1 11/2013 Dyson
2013/0305484 A1 11/2013 Dyson
2014/0059797 A1 3/2014 Kim

(56) References Cited

U.S. PATENT DOCUMENTS

| | | | |
|---|---|---|---|
| 2014/0059799 | A1 | 3/2014 | Kim |
| 2014/0082881 | A1 | 3/2014 | Conrad |
| 2014/0082883 | A1 | 3/2014 | Tran |

FOREIGN PATENT DOCUMENTS

| | | | | |
|---|---|---|---|---|
| CN | 100358463 | C | 1/2008 | |
| CN | 101662975 | A | 3/2010 | |
| CN | 101675872 | A | 3/2010 | |
| CN | 102670131 | A | 9/2012 | |
| CN | 202699043 | U | 1/2013 | |
| CN | 203436283 | U | 2/2014 | |
| EP | 1935309 | B1 | 10/2010 | |
| GB | 2477821 | A | 8/2011 | |
| WO | WO-02078506 | A1 | 10/2002 | |
| WO | WO 2007008770 | A2 * | 1/2007 | ..... A47L 5/225 |
| WO | WO-2007017821 | A1 | 2/2007 | |
| WO | WO-2008023474 | A1 | 2/2008 | |
| WO | WO-2008070964 | A1 | 6/2008 | |
| WO | WO-2009116611 | A1 | 9/2009 | |
| WO | WO-2013011793 | A1 | 1/2013 | |
| WO | WO-2015153943 | A1 | 10/2015 | |

OTHER PUBLICATIONS

International Preliminary Report on Patentability for Application No. PCT/US2015/024199 dated Oct. 4, 2016 (6 pages).
International Search Report and Written Opinion for Application No. PCT/US2015/024199 dated Jun. 8, 2015 (8 pages).

* cited by examiner

VACUUM CLEANER

CROSS-REFERENCE TO RELATED APPLICATIONS

This application claims priority to U.S. Provisional Patent Application No. 61/975,332, filed Apr. 4, 2014, the entire contents of which are hereby incorporated by reference herein.

BACKGROUND

The present invention relates to vacuum cleaners, and more particularly, to a filter arrangement for vacuum cleaners.

Vacuum cleaners typically include a suction source that generates an airflow. The airflow is typically drawn through a suction nozzle and into a dirt separator. The dirt separator can include a cyclonic separator. Downstream from the cyclonic separator, the vacuum often includes a filter that filters the airflow before the airflow is discharged to atmosphere.

SUMMARY

In one embodiment, the invention provides a vacuum cleaner that includes a suction source, a main body, a dirt separator removably coupled to the main body, a pre-motor filter in contacting engagement with the main body in a vertically orientated plane, and a post-motor filter in contacting engagement with the main body along the vertically orientated plane.

In another embodiment, the invention provides a vacuum cleaner that includes a suction source, a main body, a dirt separator removably coupled to the main body, and a pre-motor filter removably coupled to the main body. The pre-motor filter is configured to be coupled to the main body in a first orientation and a second orientation.

In another embodiment, the invention provides a vacuum cleaner that includes a suction source, a main body, and a dirt separator removably coupled to the main body. The dirt separator having an outlet along an axis and a pre-motor filter in contacting engagement with the main body in a vertically orientated plane, the filter intersecting the axis.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
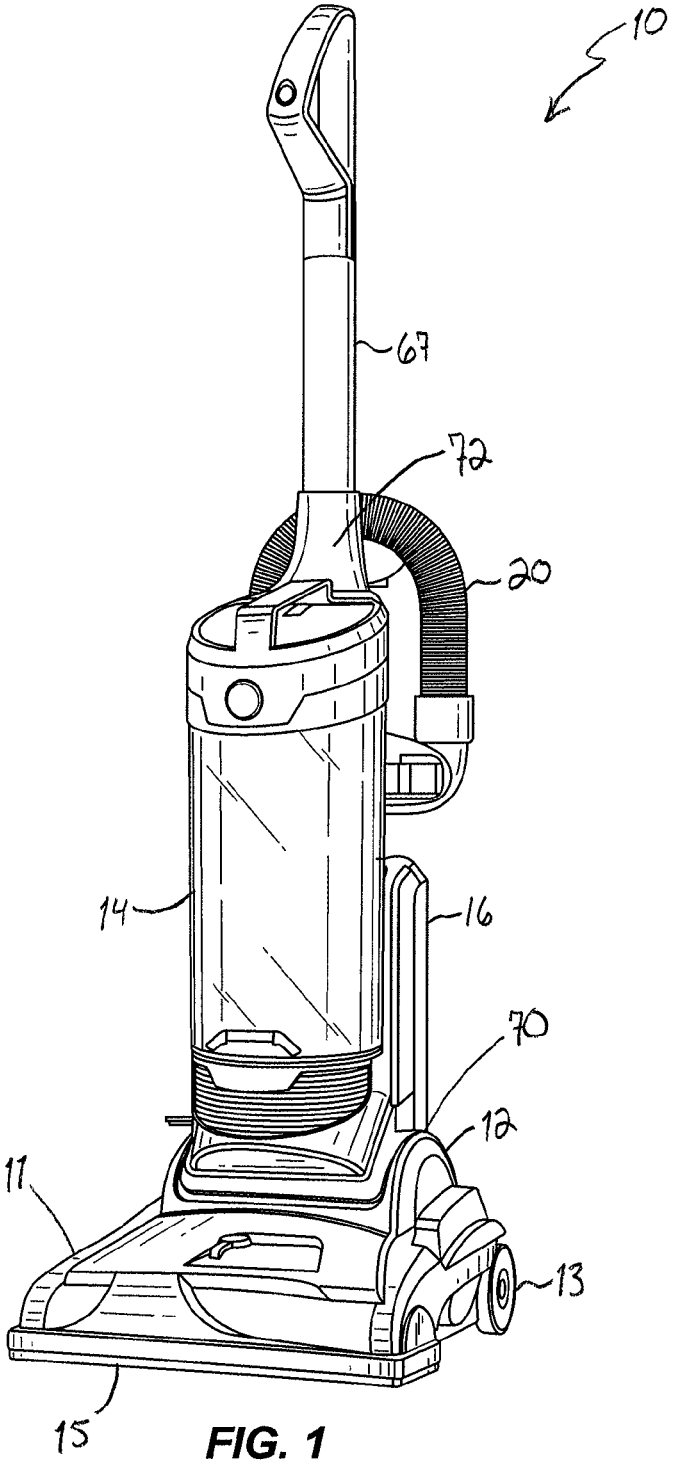
FIG. 1 is a perspective view of a vacuum cleaner according to one embodiment of the invention.

FIG. 1 illustrates a vacuum cleaner 10 (hereinafter referred to simply as a vacuum). The vacuum 10 includes a base 11, suction source 12, a dirt separator 14, and a main body 16. In the illustrated embodiment, the main body 16 is pivotally coupled to the base 11 such that the main body is 16 is pivotable relative to the base 11 between an upright storage position (illustrated in FIG. 1) and inclined operating positions. The illustrated base 11 includes wheels 13 that allow the base 11 to move along a surface being cleaned. The base 11 further includes a suction nozzle 15 in fluid communication with the dirt separator 14 and the suction source 12.

The suction source 12 is located within the body 16 and in one embodiment the suction source 12 includes an electric motor and a fan. The motor is operable to rotate the fan to generate a suction airflow. The vacuum cleaner 10 further includes an inlet duct 20. The inlet duct 20 is in fluid communication with the suction nozzle 15 and the dirt separator 14 and the inlet duct 20 directs the airflow from the suction nozzle 15 to the dirt separator 14. In the illustrated embodiment, the dirt separator 14 is removably coupled to the body 16 and the inlet duct 20.

Figure 2:
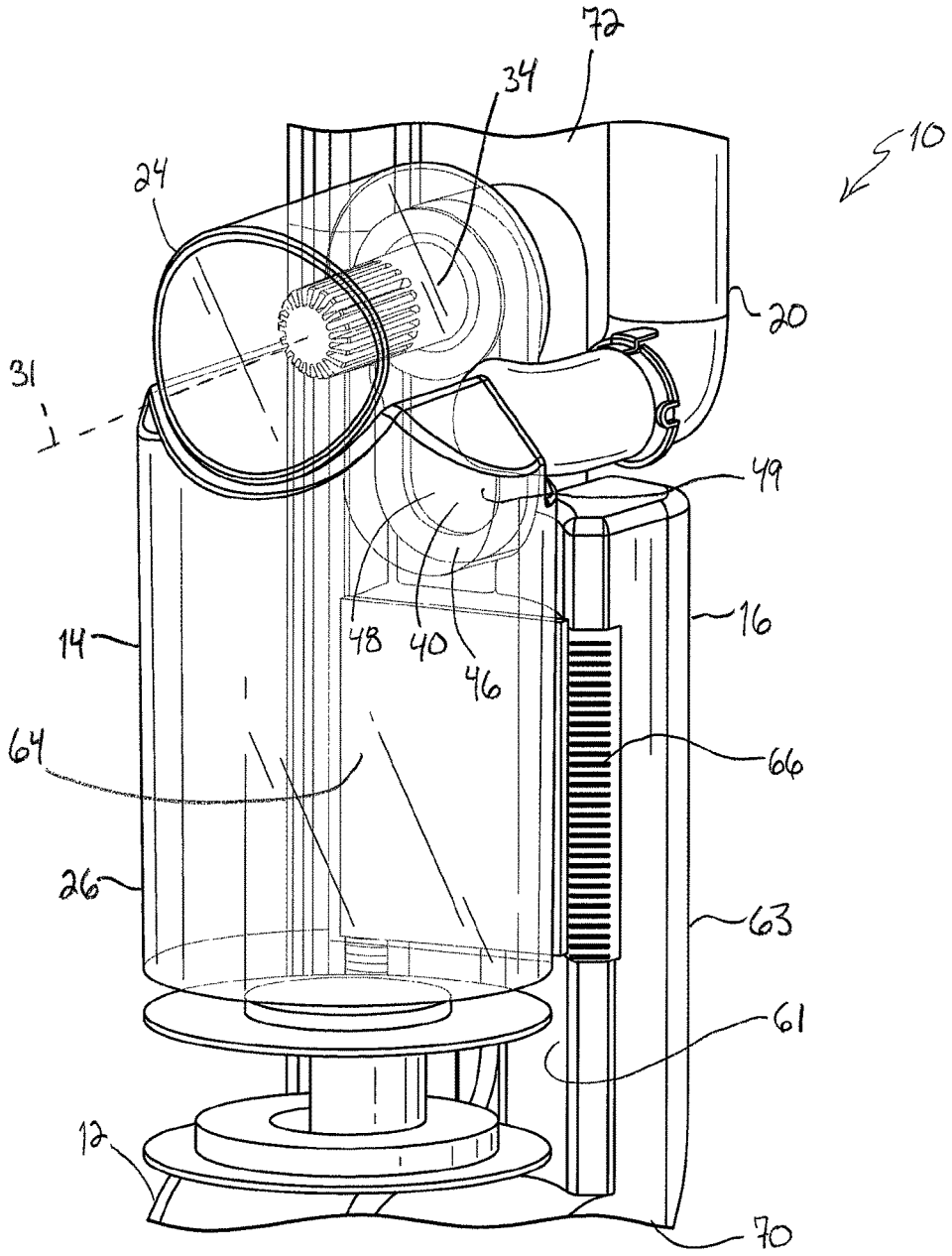
FIG. 2 is a perspective view of a portion of a vacuum cleaner of FIG. 1.
Figure 5:
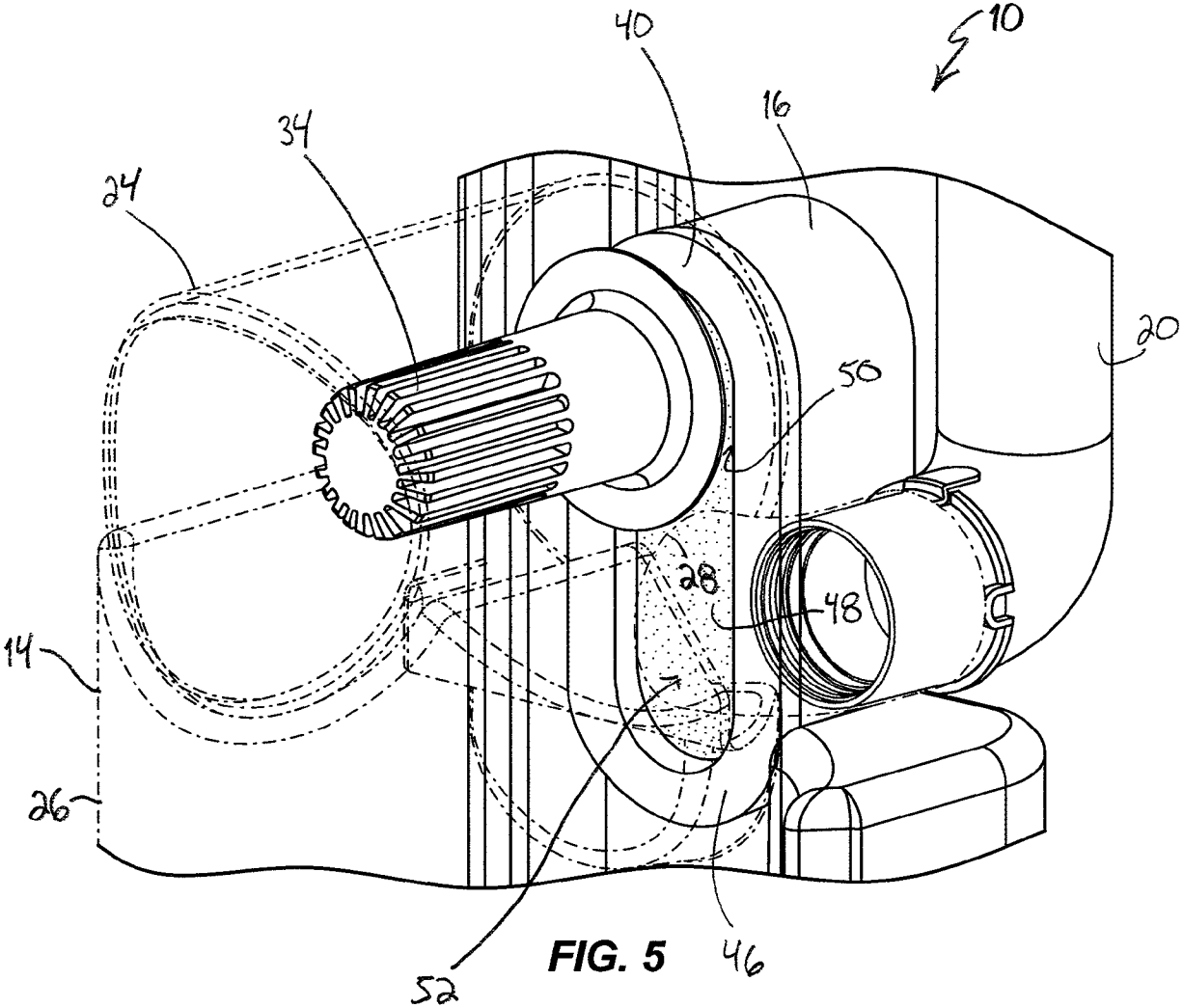
FIG. 5 is an enlarged perspective view of the vacuum cleaner of FIG. 1.
Figure 6:
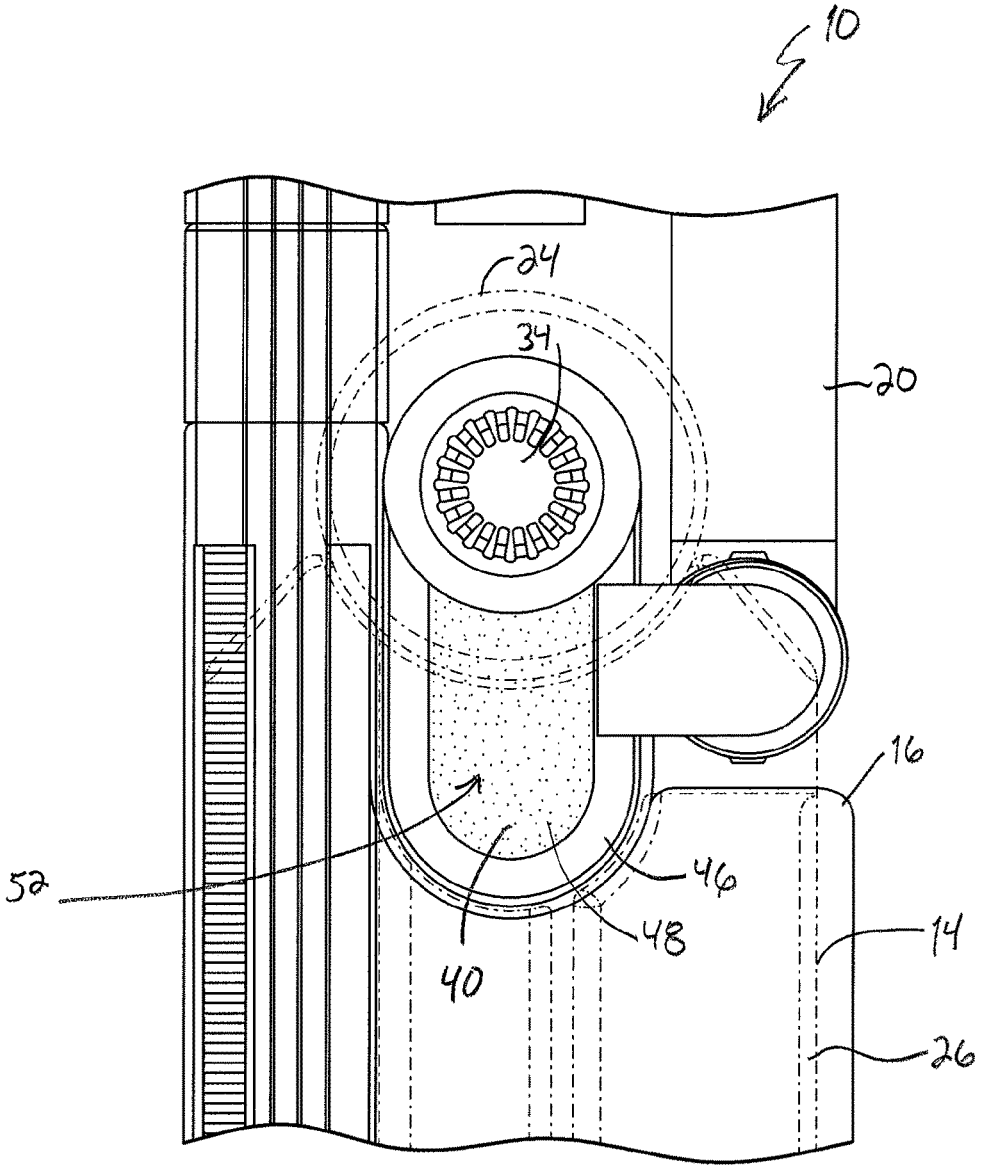
FIG. 6 is an enlarged front view of the vacuum cleaner of FIG. 1.
Figure 7:
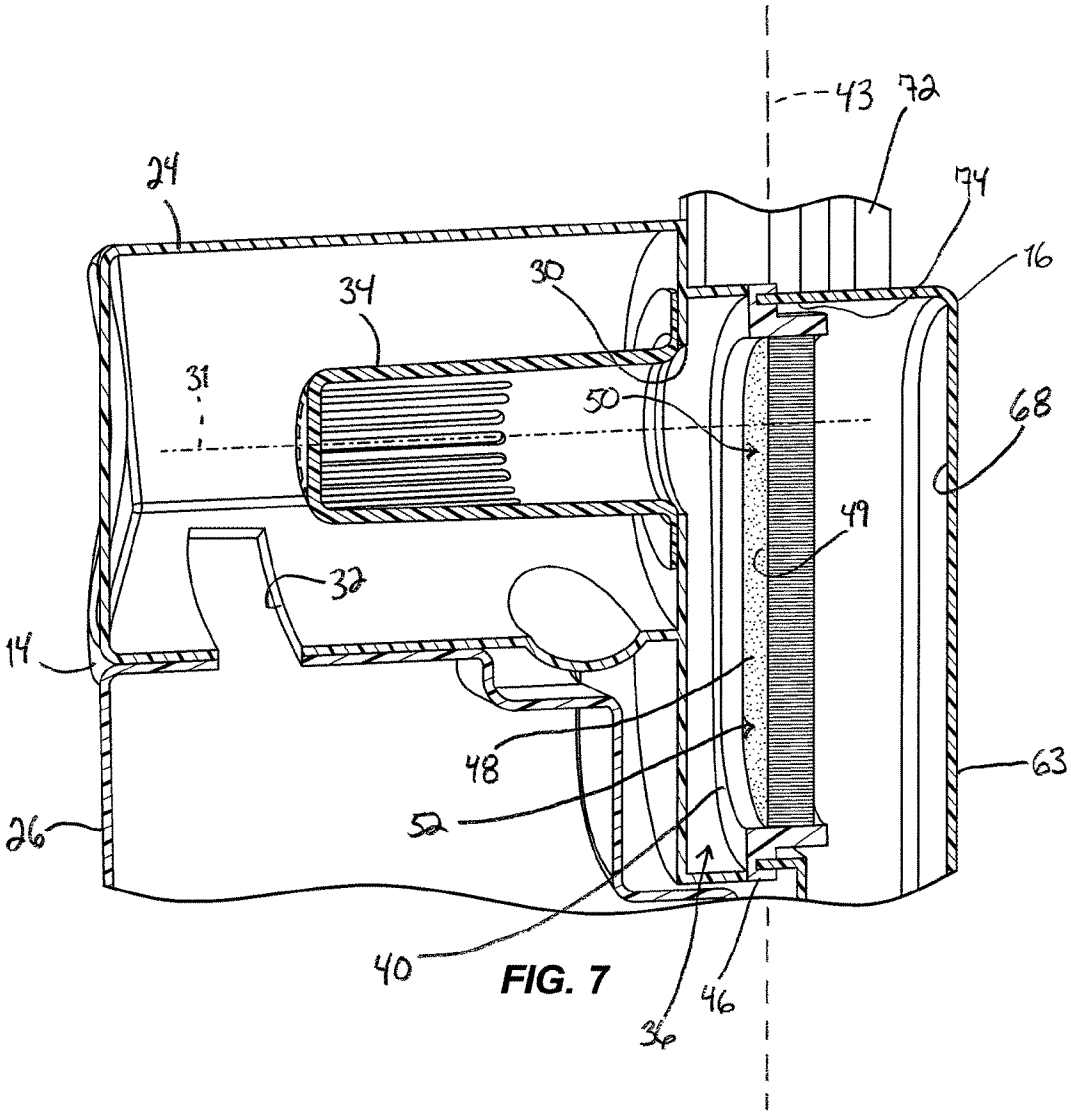
FIG. 7 is a partial cross-sectional view of the vacuum cleaner of FIG. 1.

Referring to FIGS. 2 and 7, the illustrated dirt separator 14 includes a cyclonic separator 24 and a dirt cup 26. The cyclonic separator 24 includes an inlet 28 (FIG. 5) and an outlet 30, the outlet 30 along an axis 31. An aperture 32 extends between the cyclonic separator 24 and the dirt cup 26. The aperture 32 allows dirt and debris separated from the airflow by the cyclonic separator 24 to travel into the dirt cup 26 for storage until the dirt cup 26 is emptied by the user. A screen 34 is located in the cyclonic separator 24 adjacent the outlet 30. The screen 34 is positioned so that the airflow must travel through the screen 34 before exiting the separator 24 through the outlet 30. The screen 34 inhibits relatively large debris from traveling through the outlet 30. In one embodiment, the screen 34 can also include filter media. As seen in FIG. 7 and as will be discussed in more detail below, the dirt separator 14 further includes an outlet plenum 36. In the illustrated embodiment, the cyclonic separator 24 is generally horizontal and the axis 31 about which the cyclonic airflow travels extends through the main body 16 generally perpendicular to the main body 16. In other embodiments, the cyclonic separator may be horizontal and the axis 31 about which the cyclonic airflow travels does not extend through the main body 16 (e.g., axis 31 about which the cyclonic airflow travels is parallel to the main body 16). In the other embodiments, the axis 31 about which the cyclonic airflow travels can be vertically oriented.

Figure 4:
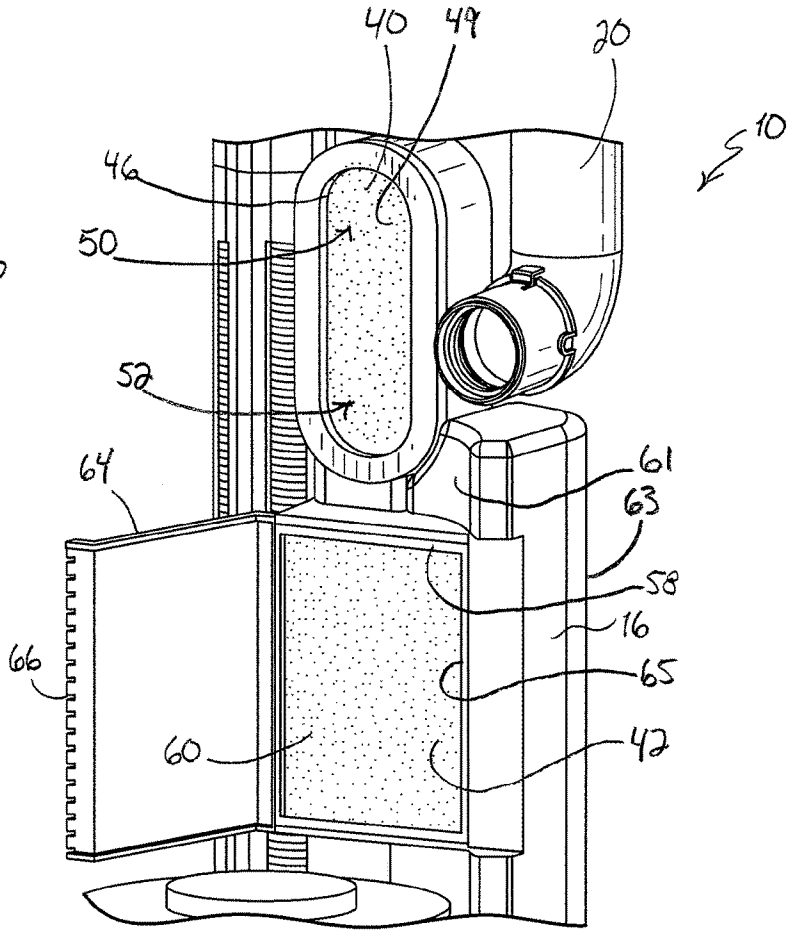
FIG. 4 is a perspective view of the vacuum cleaner of FIG. 1 with the dirt separator removed and a door for a filter chamber in an open position.
Figure 3:
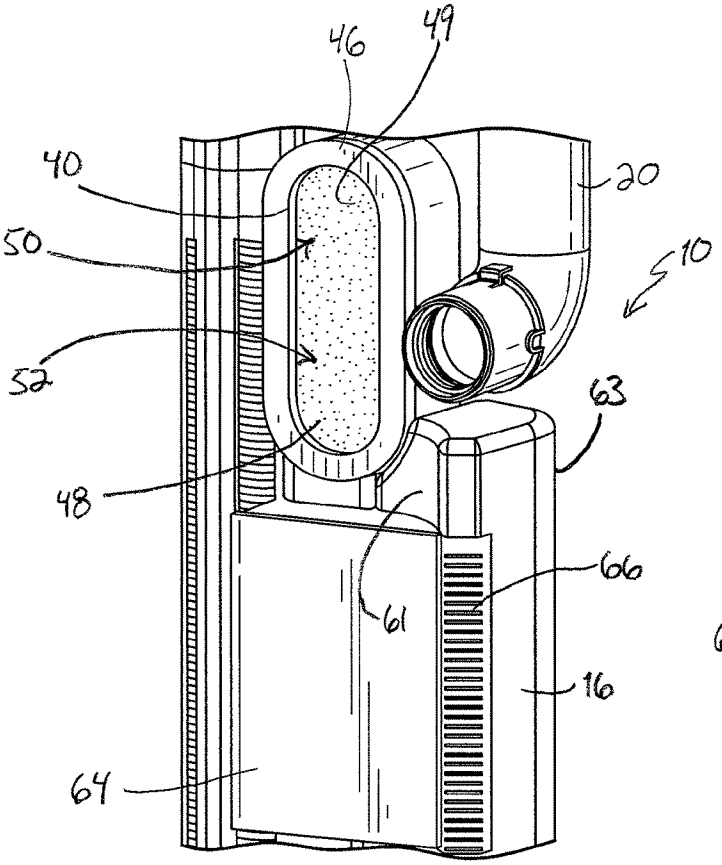
FIG. 3 is a perspective view of the vacuum cleaner of FIG. 1 with a dirt separator removed.

Referring to FIGS. 2-4, the vacuum 10 further includes a first filter 40 and a second filter 42. The first filter 40 is located upstream from the suction source 12 and therefore, the first filter 40 is a pre-motor filter. The second filter 42 is located downstream or after the suction source 12 and is therefore a post-motor filter.

Figure 8:
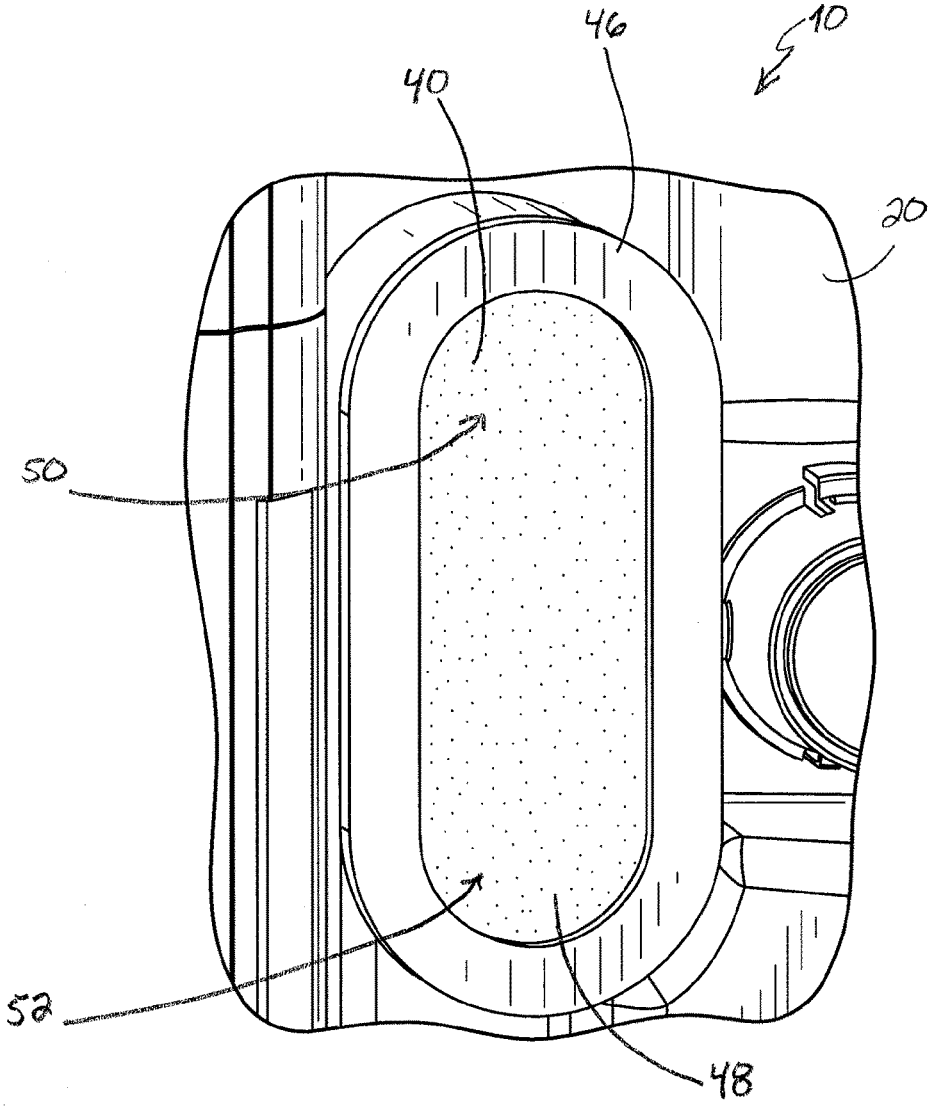
FIG. 8 is an enlarged perspective view of the vacuum cleaner of FIG. 1 with the dirt separator removed.

As best seen in FIGS. 7 and 8, the pre-motor filter 40 is positioned adjacent the outlet 30 such that the filter 40 intersects the axis 31 and the pre-motor filter 40 is located in a vertically orientated plane 43. The plane 43 is vertically orientated relative to the surface being cleaned, which is the surface on which the base 11 moves in the illustrated embodiment. The pre-motor filter 40 further includes a seal 46 and filter media 48. The seal 46 inhibits air leakage between the filter 40 and the main body 16. The seal 46 also contacts the dirt separator 14 when the separator 14 is coupled to the main body 16 such that the seal 46 inhibits air leakage around the outlet plenum 36. The filter media 48 includes a filter face 49 in the plane 43 and the filter face 49 generally includes a first half 50 and a second half 52. In the illustrated configuration, the first half 50 is adjacent the outlet 30 of the cyclonic separator 24. However, pre-motor filter 40 may be configured to be coupled to the main body in a first orientation and a second orientation. In the illustrated embodiment, the filter 40 is removably coupled to the main body 16 so that the orientation of the filter 40 can be rotated 180 degrees such that the second half 52 of the filter media 48 is adjacent the outlet 30. For example, after a period of use of the vacuum 10, the first half 50 of the filter media 48 (adjacent the outlet 30) can become more entrained with debris than the second half 52, which may reduce the efficiency of the filter 40. The first half 50 becomes more entrained with debris because it is closer to the outlet 30. When the user removes the dirt separator 14, for example for emptying, the user may notice that the first half 50 of the filter 40 is dirtier than the second half 52. The user can then rotate the filter 180 degrees so that the cleaner second half 52 is adjacent the outlet 30. In one embodiment, the plenum 36 includes a horizontal wall that is vertically centered and the wall extends to the filter 40. The wall would generally separate the filter halves 50, 52 so that only one of the filter halves 50, 52 (the filter half 50 or 52 that is adjacent the outlet 30) is used to filter debris from the airflow.

Referring to FIGS. 3 and 4, the post-motor filter 42 includes a seal 58 and filter media 60. The seal 58 inhibits air leakage between the filter 42 and the main body 16. The pre-motor filter 40 is in contacting engagement with the main body 16 in the vertically orientated plane 43 (FIG. 7), and the post-motor filter 42 is in contacting engagement with the main body along the vertically orientated plane 43 of the pre-motor filter 40. In the illustrated embodiment, the pre-motor filter 40 and the post-motor filter 42 are both removably coupled to the main body 16 such that the filters 40, 42 are vertically orientated along the same vertical plane 43. Alternatively, one or both of the pre-motor filter 40 and the post-motor filter 42 may be removably coupled to the dirt separator 14 such that the filters 40, 42 are vertically orientated along the vertical plane 43. The post-motor filter 42 may be in the same vertical plane 43 as the pre-motor filter 40, and therefore, the plane 43 extends through the post-motor filter 42. Alternatively, the post-motor filter 42 may be in a vertical plane offset from the pre-motor filter 40. In another embodiment, the post-motor filter 42 may be angled slightly relative to the vertical plane 43 and the vertical plane 43 extends through the post-motor filter 42.

Also, in the illustrated embodiment, both filters 40, 42 remain attached to the main body 16 when the dirt separator 14 is removed or uncoupled from the main body 16. Generally, both filters 40, 42 are located behind the dirt separator 14. The main body 16 includes a first side 61 that generally faces the dirt separator 14 and a second side 63 opposed to the first side 61. In the illustrated embodiment, the filters 40, 42 are accessible from the first side 61 of the main body 16. Therefore, the filters 40, 42 are generally inaccessible when the dirt separator 14 is coupled to the main body 16 and the filters 40, 42 are accessible when the dirt separator in uncoupled from the main body 16. In other embodiments, the filters 40, 42 are accessible from the second side 63 of the body 16 so that the filters 40, 42 are accessible when the dirt separator 14 is attached to the main body 16. A door 64 provides access to a post-motor filter chamber 65. The filter chamber 65 receives the post-motor filter 42 to couple the filter 42 to the main body 16. The door 64 may include vent apertures 66. In one embodiment, the door 64 is pivotally coupled to the main body 16. In another embodiment, the door 64 is coupled to the dirt separator 14 and the door 64 is removed from the main body 16 when the dirt separator 14 is uncoupled from the main body 16.

The main body 16 further includes a handle 67 (FIG. 1) gripped by the user to move the base 11 of the vacuum cleaner 10 along the surface being cleaned. The main body 16 further includes a lower end 70 adjacent the base 11 and an upper end 72 adjacent the handle 67. The post-motor filter 42 is coupled to the main body 16 below the pre-motor filter 40, between the pre-motor filter 40 and the lower end 70 of the base 11. The pre-motor filter 40 is coupled to the main body 16 between the post-motor filter 42 and the upper end 72 of the main body 16. The main body further includes a duct 68 (FIG. 7) that provides fluid communication between the dirt separator 16 and the suction source 12 and the pre-motor filter 40 is located in the duct 68. The duct 68 includes an inlet 74 adjacent the dirt separator 16 and the pre-motor filter 40 is adjacent the inlet 74.

In operation, the suction source 12 generates an airflow that is drawn through the suction nozzle 15, along with debris, through the inlet duct 20 and into the cyclonic separator 24. A majority of the debris is separated from the airflow in the cyclonic separator 24 and travels through the aperture 32 and into the dirt cup 26. The airflow then travels through the screen 34 where any remaining coarse debris is separated from the airflow. The airflow then exits through the outlet 30 and travels generally perpendicularly through the face 49 of the pre-motor filter 40 and through the pre-motor filter 40 and into the duct 68 (FIG. 7) in the main body 16. The pre-motor filter 40 filters relatively fine debris or dust from the airflow. The airflow then travels through the duct 68 and to the suction source 12. The airflow can be used to cool the motor of the suction source 12. The suction source 12 discharges the air to the post-motor filter 42. The post-motor filter 42 further filters the airflow before it is discharged to atmosphere through the vent apertures 66 in the door 64 or through other vent apertures as desired.

When the dirt cup 26 is full, the user detaches the dirt separator 14 from the main body 16 to empty the dirt cup 26. Meanwhile, in the illustrated embodiment, the filters 40, 42 remain attached to the main body 16. The user can open the door 64 to inspect and change the post-motor filter 42. Also, the user can inspect, change, or rotate the pre-motor filter 40, as discussed above.

Various features and advantages of the invention are set forth in the following claims.

What is claimed is:

1. A vacuum cleaner comprising:

a suction source;

a main body;

a dirt separator removably coupled to the main body;

a base including a suction nozzle, the base configured to move along a surface to be cleaned, the main body is pivotally coupled to the base and pivotable relative to the base between an upright storage position and an inclined operating position;

a pre-motor filter in contacting engagement with the main body in a vertically orientated plane; and a post-motor filter in contacting engagement with the main body along the vertically orientated plane, wherein air flows through the pre-motor filter and the post-motor filter in substantially the same direction, wherein the pre-motor filter and the post-motor filter are inaccessible for replacement when the dirt separator is coupled to the main body and the pre-motor filter and the post-motor filter are accessible for replacement when the dirt separator in uncoupled from the main body.

2. The vacuum cleaner of claim 1, wherein the vertically orientated plane extends through post-motor filter.

3. The vacuum cleaner of claim 1, wherein the post-motor filter is generally parallel to the vertically orientated plane.

4. The vacuum cleaner of claim 3, wherein the post-motor filter is located in the vertically orientated plane.

5. The vacuum cleaner of claim 1, wherein the pre-motor filter includes a pre-motor filter face, the pre-motor filter configured to filter an airflow that travels through the pre-motor filter generally perpendicular to the pre-motor filter face, and wherein the pre-motor filter face defines the vertically orientated plane.

6. The vacuum cleaner of claim 5, wherein the dirt separator includes a cyclonic separator and a dirt cup configured to receive debris separated by the cyclonic separator.

7. The vacuum cleaner of claim 1, wherein the main body includes a first side that generally faces the dirt separator and a second side opposed to the first side, wherein the pre-motor filter and the post-motor filter are accessible from the first side of the main body.

8. The vacuum cleaner of claim 7, wherein the pre-motor filter and the post-motor filter are generally inaccessible when the dirt separator is coupled to the main body and in fluid communication with the suction source.

9. The vacuum cleaner of claim 8, wherein the pre-motor filter and the post-motor filter are generally accessible when the dirt separator is uncoupled from the main body.

10. The vacuum cleaner of claim 1, wherein the main body includes a post-motor filter chamber, the post-motor filter received within the post-motor filter chamber to couple the post-motor filter to the main body.

11. The vacuum cleaner of claim 10, further comprising a door that encloses and provides accesses to the post-motor filter chamber.

12. The vacuum cleaner of claim 11, wherein the door is pivotally coupled to the main body.

13. The vacuum cleaner of claim 11, wherein the door is coupled to the dirt separator and removable with the dirt separator from the main body.

14. The vacuum cleaner of claim 1, wherein the main body includes a handle configured to move the vacuum cleaner along the surface, wherein the main body includes a lower end adjacent the base and an upper end adjacent the handle, wherein the post-motor filter is coupled to the main body below the pre-motor filter, between the pre-motor filter and the lower end of the base, and wherein the pre-motor filter is coupled to the main body between the post-motor filter and the upper end of the main body.

15. The vacuum cleaner of claim 1, wherein the main body includes a duct that provides fluid communication between the dirt separator and the suction source and the pre-motor filter is located within the duct.

16. The vacuum cleaner of claim 15, wherein the duct includes an inlet adjacent the dirt separator, wherein the pre-motor filter is adjacent the inlet.

17. The vacuum cleaner of claim 1, wherein the pre-motor filter is removably coupled to the main body and the pre-motor filter is configured to be coupled to the main body in a first orientation and a second orientation.

18. The vacuum cleaner of claim 17, wherein the first orientation is 180 degrees from the second orientation.

19. The vacuum cleaner of claim 1, wherein the dirt separator includes an outlet along an axis, and wherein the pre-motor filter intersects the axis.

20. The vacuum cleaner of claim 1, wherein air flows through the pre-motor filter in a first direction and the post-motor filter in a second direction, wherein the first direction and second direction are substantially parallel.

21. The vacuum cleaner of claim 1, further including a first face of the pre-motor filter and a second face of the post-motor filter, wherein the first face and the second face are substantially parallel.

22. The vacuum cleaner of claim 1, wherein the dirt separator further includes a dirt cup configured to be removed from the main body in order to access the pre-motor filter and the post-motor filter.

23. The vacuum cleaner of claim 1, wherein the dirt separator further includes a dirt cup, wherein the pre-motor filter and the post-motor filter are positioned substantially adjacent a side of the dirt cup.

24. The vacuum cleaner of claim 1, wherein the post-motor filter includes a door positioned between the post-motor filter and the dirt separator.

25. The vacuum cleaner of claim 1, wherein the dirt separator further includes a dirt cup extending along a second vertically oriented plane, wherein the second vertically oriented plane is substantially parallel to the vertically oriented plane.

* * * * *